US005425677A

United States Patent [19]

Gleeson et al.

[11] Patent Number: 5,425,677

[45] Date of Patent: Jun. 20, 1995

[54] PLAY ENCLOSURE HAVING VISUALLY STIMULATING LIGHTING

[75] Inventors: James F. Gleeson; Richard J. Petersheim, both of Charlotte, N.C.

[73] Assignee: Discovery Zone, Inc., Chicago, Ill.

[21] Appl. No.: 97,494

[22] Filed: Jul. 23, 1993

[51] Int. Cl.[6] ..... A63B 21/04

[52] U.S. Cl. ..... 472/136; 472/62

[58] Field of Search ..... 472/61, 62, 136, 137; D21/108

[56] References Cited

PUBLICATIONS

Brochure "Introducing Leaps & Bounds" distributed by affiliates of assignee. The date of the brochure is prior to the filing date of the present application. Brochure distributed by Soft Play, Inc. prior to the filing date of the present application.

*Primary Examiner*—Carl D. Friedman
*Assistant Examiner*—Beth A. Aubrey
*Attorney, Agent, or Firm*—Jenner & Block

[57] ABSTRACT

A play enclosure is disclosed including an elongated conduit having a plurality of light admitting pinpoint apertures. The conduit is curved and has a diameter large enough to allow children to crawl through. A strobe light is suspended above the conduit. The pinhole apertures admit beams of light from the strobe light, which cast visually stimulating patterns on the internal wall of the conduit.

18 Claims, 2 Drawing Sheets

FIG. 1
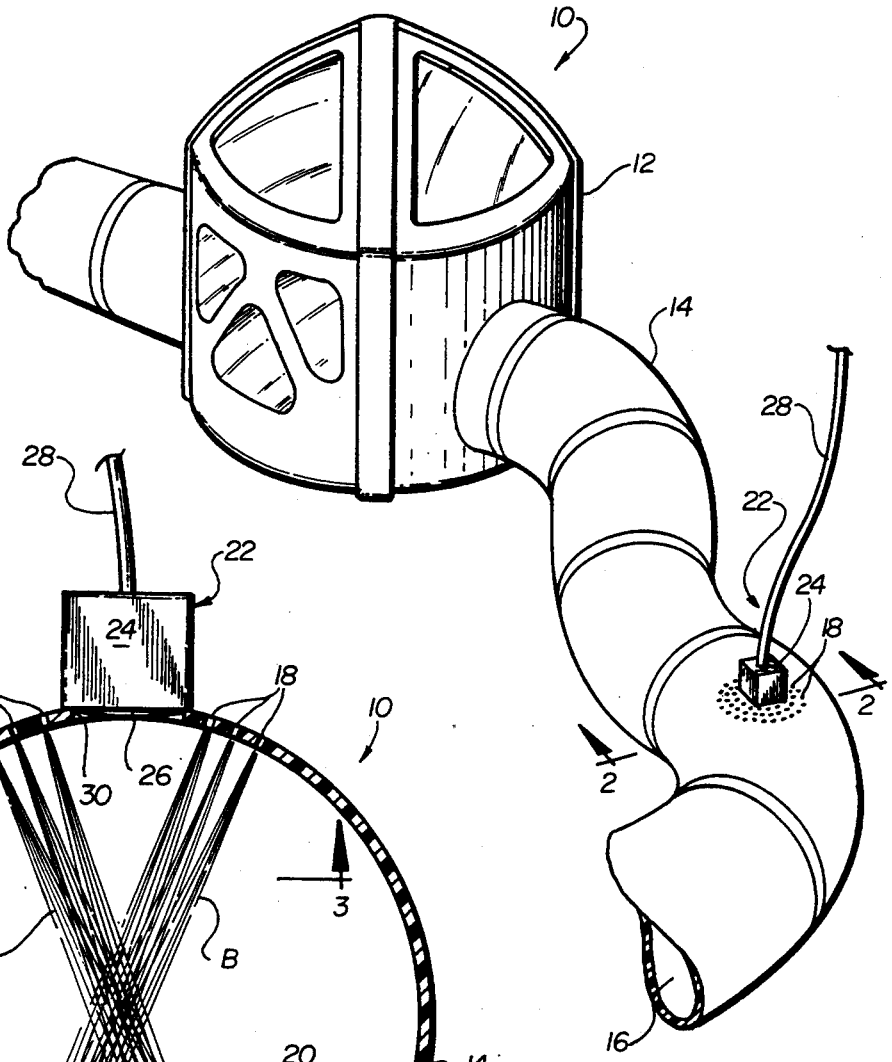
FIG. 2
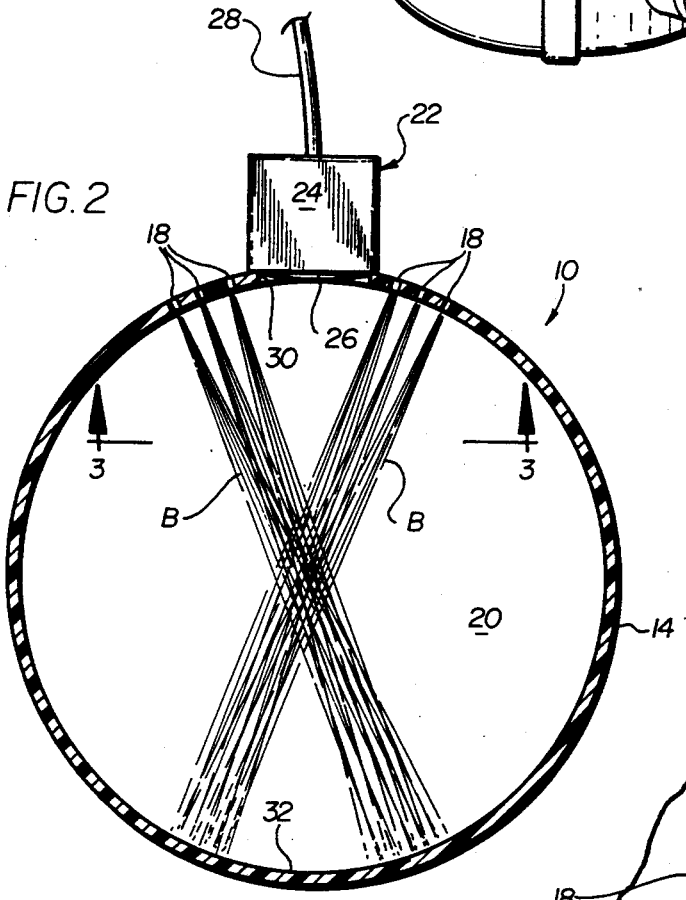
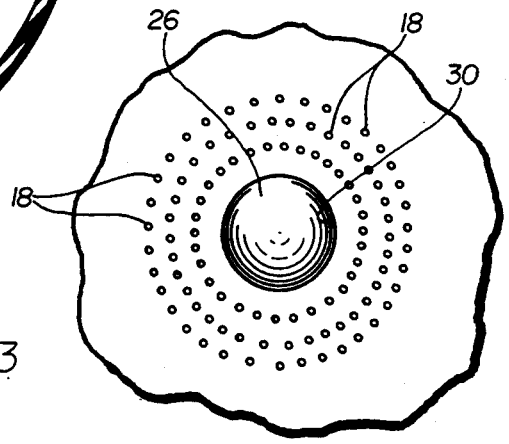
FIG. 3

PLAY ENCLOSURE HAVING VISUALLY STIMULATING LIGHTING

FIELD OF THE INVENTION

This invention relates to equipment particularly suited for recreational use by children. In particular, the invention relates to play equipment for use in indoor playgrounds.

BACKGROUND OF THE INVENTION

While children's play equipment has been around for decades, many parents are unaware of the fundamental role play equipment has in a child's physical, mental and social developments. Generally, play equipment, such as well-known playground slides and monkey bars, does not offer the fullest opportunity for children to develop. In particular, there is the need for play equipment that stimulates children's natural curiosity and improves their mental and physical development.

SUMMARY OF THE INVENTION

In accordance with the invention, a play enclosure is disclosed which provides children, and particularly small children, with safe, challenging play by which the children can develop their imaginations, self-confidence, physical strength, agility and social skills.

In one embodiment, a play enclosure includes an elongated conduit. The conduit has a transverse cross-section that is large enough for children to crawl through. A number of pinpoint apertures are located through the top portion of the conduit along its longitudinal extent. Each pinpoint aperture has a diameter suitable for admitting a beam of ambient light into the interior of the conduit. Lamps or other light sources are suspended above the conduit and cast light into the pinhole apertures. The pinhole apertures admit beams of light into the interior of the conduit. The beams of light strike the bottom portion of the internal wall of the conduit creating visually stimulating patterns.

In another embodiment, the elongated conduit includes a larger aperture in addition to the pinhole apertures. A light source is mounted to the conduit over the larger aperture so that it can cast light through the larger aperture into the interior of the conduit. The pinhole apertures can be arranged in concentric circles around the larger aperture or in other patterns as desired.

In some cases the light source is a strobe light. The light source can flash at regular or irregular intervals. Ideally, the conduit is curved so as to reduce the amount of ambient light entering through the longitudinal openings in the conduit.

BRIEF DESCRIPTION OF THE DRAWINGS

FIG. 1 is a perspective view of a play enclosure in accordance with a first embodiment of the invention;

FIG. 2 is a sectional view of the play enclosure shown in FIG. 1 taken along the lines 2—2;

FIG. 3 is a view from within the conduit of the play enclosure shown in FIG. 1;

DESCRIPTION OF THE PREFERRED EMBODIMENTS

Figure 4:
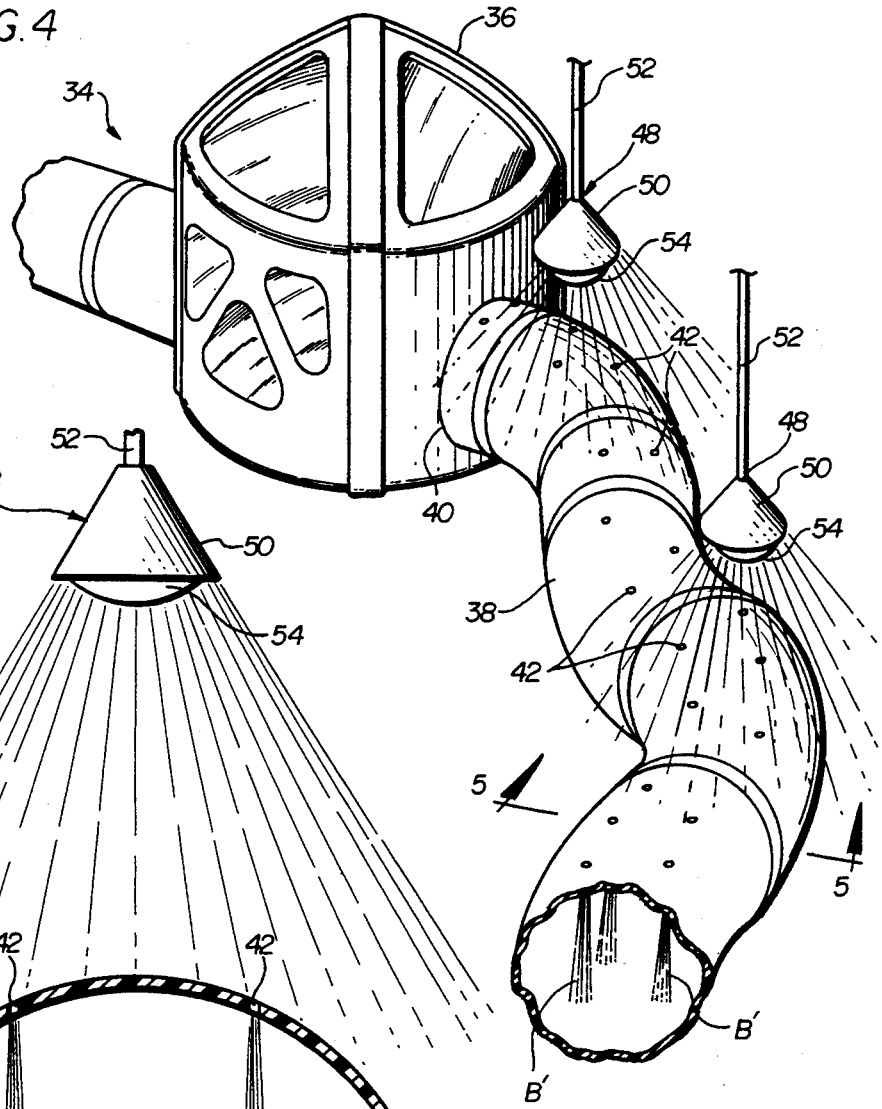
FIG. 4 is a perspective view of a play enclosure in accordance with a second embodiment of the invention.

Referring to FIG. 1, a play enclosure 10 is illustrated having a play house 12 and an elongated conduit 14 extending from playhouse 12. Although conduit 14 as illustrated is cylindrical, this is not essential. Conduit 14 may have a rectilinear or other-shaped cross-section. Conduit 14 has an internal diameter of sufficient width to allow a child to comfortably and safely crawl therethrough. Conduit 14 may be straight but is preferably curved as shown in FIG. 1. Conduit 14 should be sufficiently long and/or curved so that ambient light entering at its openings such as longitudinal opening 16 provides minimal illumination within conduit 14. Playhouse 12 illustrates one of the many play environments in which the invention may be practiced, and is not an essential part of the invention. It will be noted, however, that playhouse 12 (or other suitable enclosure) can be used as a means for reducing the amount of ambient light entering conduit 14. While the conduit 14 illustrated here has two longitudinal openings, the invention can be practiced with conduits having one opening. Alternatively, openings to the conduit need not be at longitudinal ends, but could be located elsewhere.

Referring to FIGS. 1 and 2, a plurality of light admitting (or "pinhole") apertures 18 are located along at least a portion of conduit 14. Pinhole apertures 18 are approximately 3/16" in diameter. Not every one of pinhole apertures 18 is designated by a reference numeral. Alternatively, pinhole apertures 18 may have other diameters suitable to admit beams of ambient light in the interior 20 of elongated conduit 14. A strobe light 22 is mounted to conduit 14 in close proximity to the light admitting apertures 18. As best seen in FIGS. 1 and 2, strobe light 22 includes a housing 24, a light bulb 26 mounted within housing 24, and a power cord 28 suitable for supplying electricity to light bulb 26 from any suitable power supply such as a conventional wall outlet. Preferably, light bulb 26 is a neon, halogen or other type of bulb which emits bright light at relatively low temperatures. Conventional incandescent light bulbs may generate unacceptable levels of heat. Alternatively, a neon or other light can be used° Strobe light 22 also includes conventional internal circuitry (not shown) for causing light bulb 26 to flash in a strobe fashion. Alternatively, light bulb 26 can remain on or can flash at irregular or random intervals. Light bulb 26 as shown in FIG. 2 is not illuminated.

As best seen in FIG. 2, conduit 14 includes an aperture 30 for admitting the light emanated by strobe light 22. Housing 24 of strobe light 22 is preferably of sufficient breadth and width to completely cover aperture 30, while aperture 30 is of sufficient diameter to allow most of the light of bulb 26 to enter the interior 20 of conduit 12. The peripheral edge of housing 24 is contoured to mount flushly on conduit 14 so that light emanated by bulb 26 is not directly visible external the conduit 14. Referring to FIG. 3, the apertures 18 and 30 are shown as viewed looking up from the interior 20 of conduit 14. It will be noted that apertures 18 form a plurality of concentric circles about aperture 30. The apertures 18 allow beams B of ambient light to enter the interior 20 of conduit 14 thereby creating a visually stimulating patterns of light along the bottom portion of the internal wall 32 of conduit 14, as best seen in FIG. 2. These visually stimulating patterns are particularly visible in between flashes of strobe light 22. The patterns formed by the concentric circles of light can be varied by arranging apertures 18 in other configurations such as squares and lines, for example.

Apertures 18 serve additional purposes of allowing persons external the conduit 14 to indirectly perceive the strobe effect of strobe light as its light is reflected off the internal wall 32 of conduit 14 and out through the apertures 18.

Figure 5:
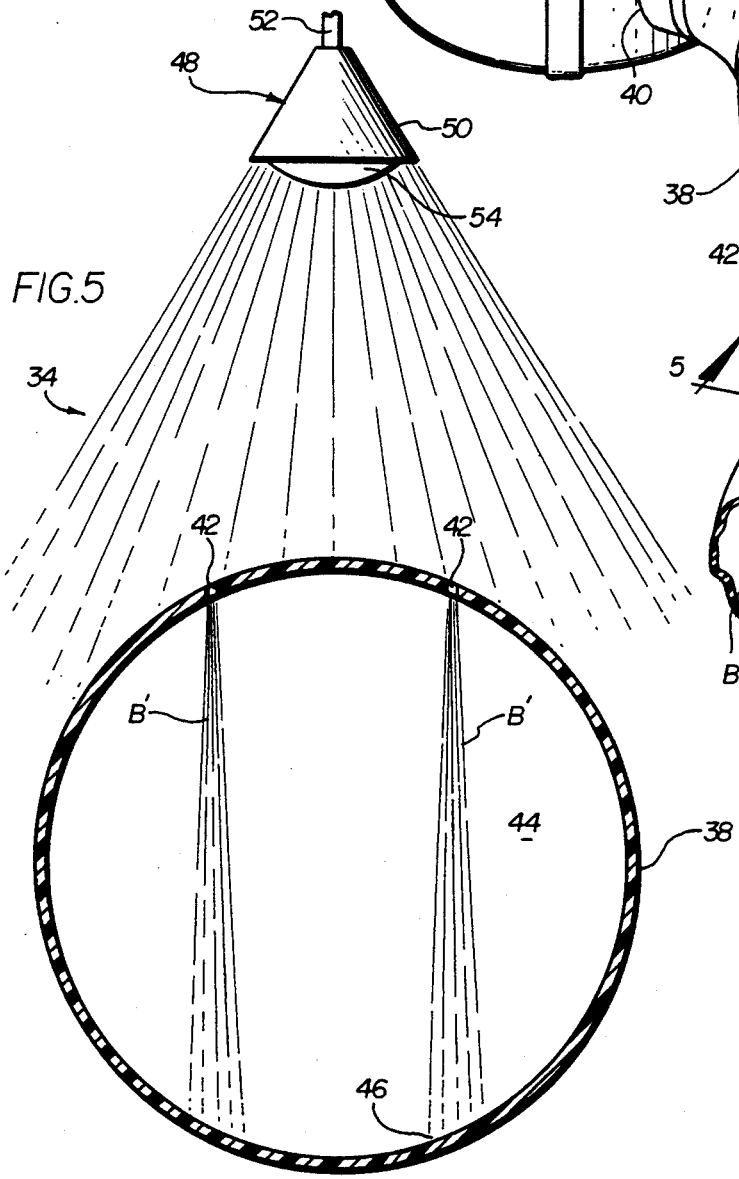
FIG. 5 is a sectional view of the play enclosure shown in FIG. 4 taken along the lines 5—5.

Turning now to FIGS. 4 and 5, a play enclosure 34 in accordance with a second embodiment of the invention is illustrated. Play enclosure 34 includes a playhouse 36 and an elongated conduit 38 extending from the playhouse 36. Conduit 38 has an internal diameter of sufficient width to allow a child to comfortably and safely crawl therethrough. Conduit 38 may be straight but is preferably curved as shown in FIG. 4. Conduit 38 should be sufficiently long and/or curved so that ambient light entering at the longitudinal openings such as opening 40 provides minimal illumination within conduit 38. Playhouse 36 illustrates one of the many play environments in which the invention may be practiced, and is not a part of the invention. It will be noted, however, that playhouse 10 (or other suitable enclosure) can be used as a means for reducing the amount of ambient light entering longitudinal opening 40 of conduit 38.

A plurality of light admitting (or "pinhole") apertures 42 are located along the longitudinal extent of conduit 38. These apertures are approximately 3/16" in diameter. Alternatively, pinhole apertures 42 may have other diameters suitable to admit a beam of ambient light into the interior 44 of conduit 38. For clarity not every one of apertures 42 in FIG. 4 is designated by a reference numeral. It will be noted that the apertures 42 are generally on the top surface of conduit 38, and form two spaced-apart rows extending along the longitudinal extent of conduit 38. Preferably, the spacing between apertures within each of these rows is at random intervals. It will be noted that apertures 42 allow beams B' of ambient light to enter the interior 44 of conduit 38 thereby creating a visually stimulating pattern of light on the bottom portion of the internal wall 46 of conduit 38. These patterns may be varied by arranging the apertures 42 in other configurations as desired. The paths of apertures 42 may be serpentine to follow the curves of conduit 38. In this manner, apertures 48 act as a lighted guideway along conduit 38.

Two lamps 48 are suspended above apertures 42. While the invention is illustrated with two lamps, the invention will function with only a single lamp or, alternatively, with more than two lamps. Each lamp 48 includes a conical housing 50, a suspension rod 52 by which the lamps 48 are suspended from the ceiling or other structure (not illustrated), and a light bulb 54. Although not shown, suspension rod 52 is hollow to accommodate a power cord for supplying electricity to the light bulb 54 from any suitable power supply such as a conventional wall outlet. Light bulb 54 is an incandescent light bulb. Alternatively a neon or other light source can be used. Lamps 48 emit light continuously. Alternatively, lamps 48 could flash at regular or irregular intervals.

Light bulbs 54 are neon, halogen or other types of bulbs which emit a bright light at relatively low temperatures. The height at which lamps 48 are suspended may vary. The closer lamps 48 are suspended over conduit 38, the brighter the light admitted by those apertures 42 which are below the lamps. However, if the lamps 48 are placed too close to conduit 38, the lamps may unacceptably heat conduit 38. A desirable lamp height may be selected in accordance with these factors and the esthetic considerations as well as other constraints such as space limitations.

Light emitted by lamps 48 (as well as other ambient light around play enclosure 34) enters the interior 44 of conduit 38 through apertures 42 creating beams B' of light. The beams B' strike the bottom portion of the internal wall 46 of conduit 38, creating visually stimulating patterns. These visually stimulating patterns are particularly visible in between flashes of lamps 48. The patterns formed by the concentric circles of light can be varied by arranging apertures 42 in other configurations such as squares and lines, for example.

Aperture 42 in conduit 38 are vertically oriented so as to readily admit light cast by lamps 48 suspended above. In contrast, apertures 18 of conduit 14 (shown in FIG. 2) are about the imaging center axis of the conduit.

In either of the embodiments shown in FIGS, 1 or 3, the conduits 14 and 38 can be filled (subject to appropriate safety considerations) with vapor (such as steam from dry ice) or particulate dust so beams B and B' are more easily seen.

While the present invention has been described with respect to the preferred embodiment, it is understood that other and further modifications, apart from those shown or suggested herein, may be made within the spirit and scope of the invention as defined in the following claims.

We claim:

1. A play enclosure, comprising:

an elongated conduit defined by at least one conduit wall and having an interior cross-section large enough to allow children to crawl therethrough;

said conduit including a plurality of pinpoint apertures extending through said conduit wall, said pinpoint apertures having a diameter suitable for admitting a beam of ambient light into the interior of said elongated conduit such that each beam of ambient light shines on a respective exclusive portion of said conduit wall; and a light source located external to said conduit, said light source positioned so that light from said light source passes through said apertures and into the interior of said conduit.

2. The play enclosure of claim 1 wherein said light source is spaced-apart from said conduit.

3. The play enclosure of claim 1 wherein said plurality of pinpoint apertures define at least two spaced-apart paths extending along the longitudinal extent of said conduit.

4. The play enclosure of claim 1 wherein said pinpoint apertures are approximately 3/16 of an inch in diameter.

5. The play enclosure of claim 1 wherein said conduit has at least one curve along its longitudinal extent.

6. The play enclosure of claim 5 further comprising a playhouse having an opening for receiving a longitudinal end of said conduit, wherein one longitudinal end of said conduit extends from said playhouse opening.

7. The play enclosure of claim 1 further comprising vapor disposed within said conduit.

8. A play enclosure, comprising:

an elongated conduit defined by at least one conduit wall having a diameter large enough to allow children to crawl therethrough;

said conduit including a plurality of pinpoint apertures extending through the conduit wall;

said pinpoint apertures having a diameter suitable for admitting a beam of ambient light into the interior of said conduit, such that each beam of ambient light shines on a respective exclusive portion of said conduit wall;

said conduit also including at least one aperture that is larger than said pinpoint apertures; and a light source mounted to said conduit over said larger aperture and adapted for casting light through said larger aperture into the interior of said conduit.

9. The play enclosure of claim 8 further comprising vapor disposed within said conduit.

10. The play enclosure of clam 8 wherein said light source is flashing light.

11. The play enclosure of claim 10 wherein said light source is a strobe light.

12. The play enclosure of claim 8 wherein said light source flashes at irregular intervals.

13. The play enclosure of claim 8 wherein said plurality of pinpoint apertures define at least one arcuate path along the wall of said conduit which at least partially circumscribes said larger aperture.

14. The play enclosure of claim 13 wherein said plurality of pinpoint apertures define a plurality of concentric circles that surround said larger aperture.

15. The play enclosure of claim 8 wherein at least a portion of said pinpoint apertures are in close proximity to said larger aperture such that light admitted by said large aperture is reflected from the interior of said conduit and out through said pinpoint apertures.

16. The play enclosure of claim 8 wherein said light source includes an open-ended, non-transparent housing for flush mounting to the exterior of said conduit, wherein said open end is positioned over said large aperture so that light emitted by said light source is not directly visible outside the conduit.

17. A play enclosure, comprising:

an elongated conduit defined by at least one conduit wall and having an interior cross-section large enough to allow children to crawl therethrough;

said conduit including a plurality of pinpoint apertures extending through said conduit wall, said pinpoint apertures being narrower than the thickness of said conduit wall; and a light source located external to said conduit, said light source positioned so that light from said light source passes through said apertures and into the interior of said conduit.

18. The play enclosure of claim 17 wherein said pinpoint apertures are suitable for admitting a beam of ambient light into the interior of said elongated conduit such that each beam of ambient light shines on a respective exclusive portion of said conduit wall.

* * * * *